US007845770B2

(12) United States Patent
Seto

(10) Patent No.: US 7,845,770 B2
(45) Date of Patent: Dec. 7, 2010

(54) LIQUID DROPLET EJECTING HEAD AND IMAGE FORMING DEVICE

(75) Inventor: Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 531 days.

(21) Appl. No.: 11/941,345

(22) Filed: Nov. 16, 2007

(65) Prior Publication Data

US 2008/0284825 A1 Nov. 20, 2008

(30) Foreign Application Priority Data

Apr. 2, 2007 (JP) ..... 2007-096285

(51) Int. Cl.
*B41J 2/045* (2006.01)
*B41J 2/14* (2006.01)

(52) U.S. Cl. ..... 347/70; 347/50; 347/68

(58) Field of Classification Search ..... 347/50, 347/58, 68–72

See application file for complete search history.

(56) References Cited

U.S. PATENT DOCUMENTS 6,336,717 B1 * 1/2002 Shimada et al. ..... 347/71
6,969,158 B2 * 11/2005 Taira ..... 347/70

FOREIGN PATENT DOCUMENTS

| | | |
|---|---|---|
| JP | 3052336 | 2/1992 |
| JP | 2000-211134 | 8/2000 |
| JP | 2005-059430 | 3/2005 |
| JP | 2006-289965 | 10/2006 |

* cited by examiner

*Primary Examiner*—Stephen D Meier
*Assistant Examiner*—Geoffrey Mruk
(74) *Attorney, Agent, or Firm*—Fildes & Outland, P.C.

(57) ABSTRACT

A liquid droplet ejecting head including a plurality of pressure chambers; nozzles communicating respectively with the plurality of pressure chambers; a vibrating plate that forms portions of the plurality of pressure chambers; a piezoelectric body disposed above the vibrating plate; individual electrodes formed respectively for each of the plurality of pressure chambers at one of a bottom surface and a top surface of the piezoelectric body, the individual electrodes being one polarity of the piezoelectric body; a common electrode, formed at the other surface of the one of a bottom surface and a top surface of the piezoelectric body, so as to extend over the plurality of pressure chambers, the common electrode being the other polarity of the piezoelectric body; electrical connecting portions electrically connected to the individual electrodes; and first electrode members electrically isolated from the common electrode, is provided.

10 Claims, 15 Drawing Sheets

LIQUID DROPLET EJECTING HEAD AND IMAGE FORMING DEVICE

CROSS-REFERENCE TO RELATED APPLICATION

This application is based on and claims priority under 35 USC 119 from Japanese Patent Application No. 2007-096285 filed on Apr. 2, 2007.

BACKGROUND

1. Technical Field

The present invention relates to a liquid droplet ejecting head and an image forming device.

2. Related Art

An inkjet recording head, which ejects ink droplets and records images, is known as a liquid droplet ejecting head.

SUMMARY

According to an aspect of the invention, there is provided a liquid droplet ejecting head, comprising: a plurality of pressure chambers in which a liquid is filled; nozzles communicating respectively with the plurality of pressure chambers, and ejecting the liquid as liquid droplets; a vibrating plate that forms portions of the plurality of pressure chambers; a piezoelectric body disposed above the vibrating plate and able to displace the vibrating plate; individual electrodes formed respectively for each of the plurality of pressure chambers at one of a bottom surface and a top surface of the piezoelectric body, the individual electrodes being one polarity of the piezoelectric body; a common electrode, formed at the other surface of the one of a bottom surface and a top surface of the piezoelectric body, so as to extend over the plurality of pressure chambers, the common electrode being the other polarity of the piezoelectric body; electrical connecting portions contacting predetermined regions of the individual electrodes, and electrically connected to the individual electrodes; and first electrode members formed on a same surface as the common electrode, and disposed at a side opposite a side at which the predetermined regions are located, with the piezoelectric body sandwiched therebetween, and electrically isolated from the common electrode.

BRIEF DESCRIPTION OF THE DRAWINGS

An exemplary embodiment of the present invention will be described in detail based on the following figures, wherein.

DETAILED DESCRIPTION

Hereinafter, an example of an exemplary embodiment relating to the present invention will be described on the basis of the drawings.

In the present exemplary embodiment, description is given by using an inkjet recording head, which effects ink droplets and records images on recoding media, as an example of a liquid droplet ejecting head which effects liquid droplets.

Further, description is given by using an inkjet recording device, which is equipped with the inkjet recording head relating to the present exemplary embodiment and ejects ink droplets from the inkjet recording head and records images on recording media, as an example of an image forming device which forms images.

Note that the liquid droplet ejecting head is not limited to a structure which records images, nor is the liquid which is ejected limited to ink. The liquid droplet ejecting head may be, for example, a liquid droplet ejecting head which ejects ink or the like onto a film or glass so as to manufacture a color filter, a liquid droplet ejecting head which ejects solder in a molten state onto a substrate so as to form bumps for parts packaging, a liquid droplet ejecting head which ejects a liquid that contains metal so as to form a wiring pattern, or a liquid droplet ejecting head for the formation of any of various types of films which ejects liquid droplets so as to form a film. It suffices for the liquid droplet ejecting head to be a structure which ejects liquid droplets.

Overall Structure of Inkjet Recording Device Relating to Present Exemplary Embodiment First, the overall structure of an inkjet recording device relating to the present exemplary embodiment will be described. The overall structure of the inkjet recording device relating to the present exemplary embodiment is shown in a schematic view in FIG. 1.

Figure 1:
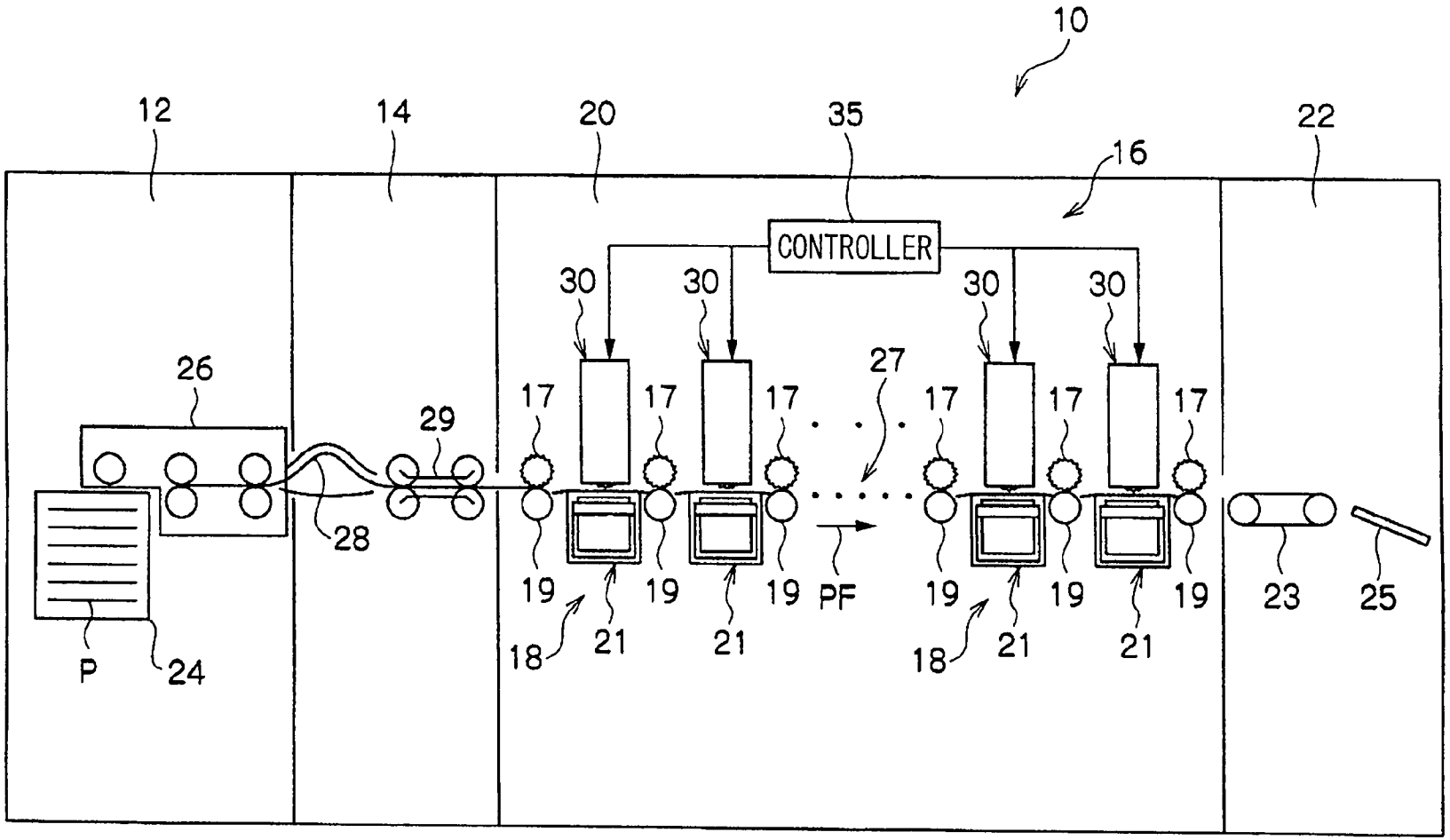
FIG. 1 is schematic front view showing an inkjet recording device relating to an exemplary embodiment of the present invention.

As shown in FIG. 1, an inkjet recording device 10 has: a sheet supplying portion 12 which feeds-out a recording sheet P which is an example of a recording medium; a registration adjusting portion 14 controlling the posture of the recording sheet P; a recording portion 20 having a recording head portion 16 which ejects ink droplets and forms an image on the recording sheet P, a controller 35 serving as an example of a control portion which supplies driving waveforms to inkjet recording heads 32 of inkjet recording units 30 of the recording head portion 16 on the basis of image data, and a maintenance portion 18 which carries out maintenance of the recording head portion 16; and a discharging portion 22 discharging the recording sheet P on which an image has been formed at the recording portion 20.

The sheet supplying portion 12 is structured from a sheet accommodating portion 24 in which the recording sheets P are stacked and accommodated, and a conveying device 26 which removes the recording sheet P one-by-one from the sheet accommodating portion 24 and conveys it to the registration adjusting portion 14. The registration adjusting portion 14 has a loop forming portion 28 and a guide member 29 which guides the recording sheet P and controls the posture of the recording sheet P. Due to the recording sheet P passing through this portion, tilting of the recording sheet P with respect to the sheet conveying direction is corrected by utilizing the strain thereof, and the conveying timing is controlled, and the recording sheet P is supplied to the recording portion 20. Further, via a sheet discharging belt 23, the discharging portion 22 accommodates the recording sheet P, on which an image has been formed at the recording portion 20, at a sheet accommodating portion 25.

A sheet conveying path 27 along which the recording sheet P is conveyed is structured between the recording head portion 16 and the maintenance portion 18 (the sheet conveying direction is shown by arrow PF). The sheet conveying path 27 (conveying portion) has star wheels 17 and conveying rollers 19, and continuously conveys the recording sheet P while nipping the recording sheet P between the star wheels 17 and the conveying rollers 19. Ink droplets are ejected from the recording head portion 16 onto the recording sheet P, and an image is formed on the recording sheet P.

The maintenance portion 18 has maintenance devices 21 which are disposed so as to oppose the inkjet recording units 30, and carries out processings on the inkjet recording heads 32 such as wiping of the nozzle surfaces and capping, as well as preliminary ejecting of ink droplets, suctioning of ink, and the like.

Figure 2:
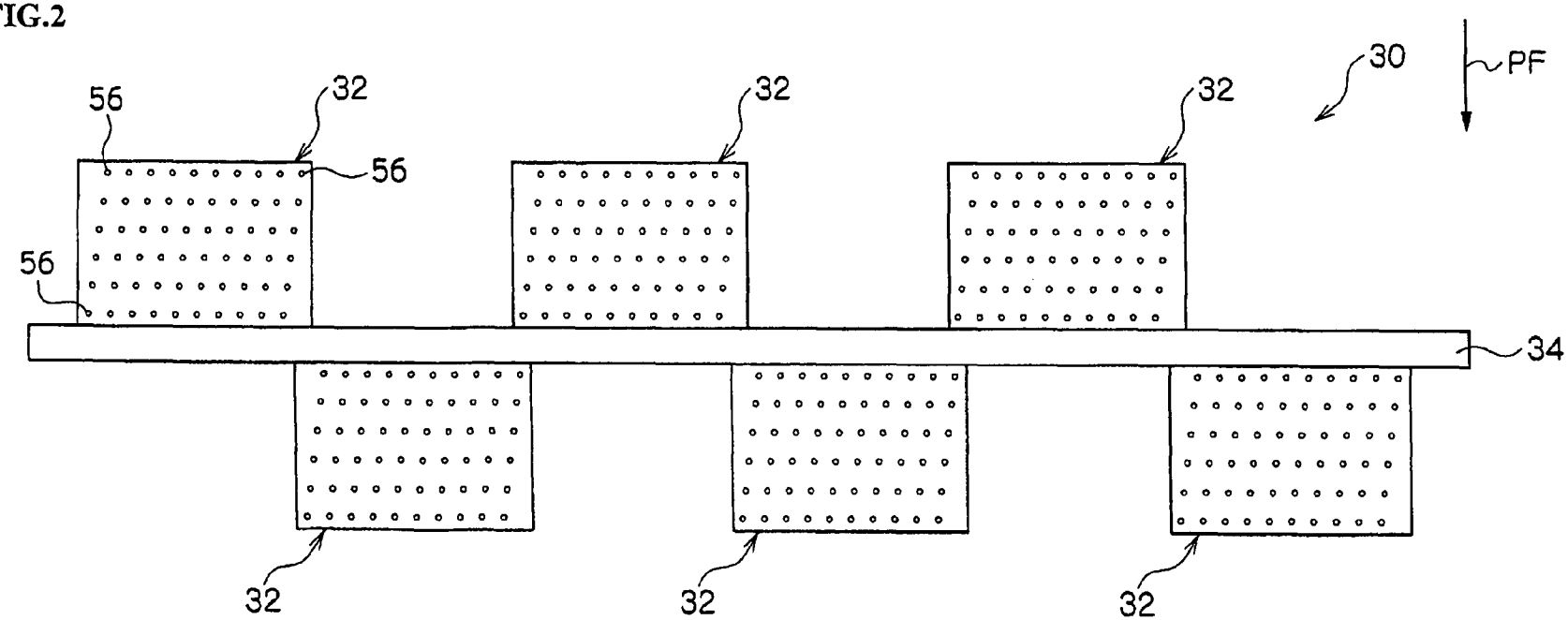
FIG. 2 is an explanatory drawing showing an array of inkjet recording heads relating to the present exemplary embodiment.

As shown in FIG. 2, each inkjet recording unit 30 has a supporting member 34 which is disposed in a direction intersecting the sheet conveying direction shown by arrow PF. A plurality of the inkjet recording heads 32 are mounted to the supporting member 34. Plural nozzles 56 are formed in a two-dimensional form at the inkjet recording head 32, such that the nozzles 56 are lined-up at a uniform pitch across the overall inkjet recording unit 30 in the transverse direction of the recording sheet P.

An image is recorded on the recording sheet P by ink droplets being ejected from the nozzles 56 onto the recording sheet P which is conveyed continuously along the sheet conveying path 27. Note that four of the inkjet recording units 30 are disposed in correspondence with the respective colors of yellow (Y), magenta (M), cyan (C), and black (K) in order to record a so-called full-color image for example.

Figure 3:
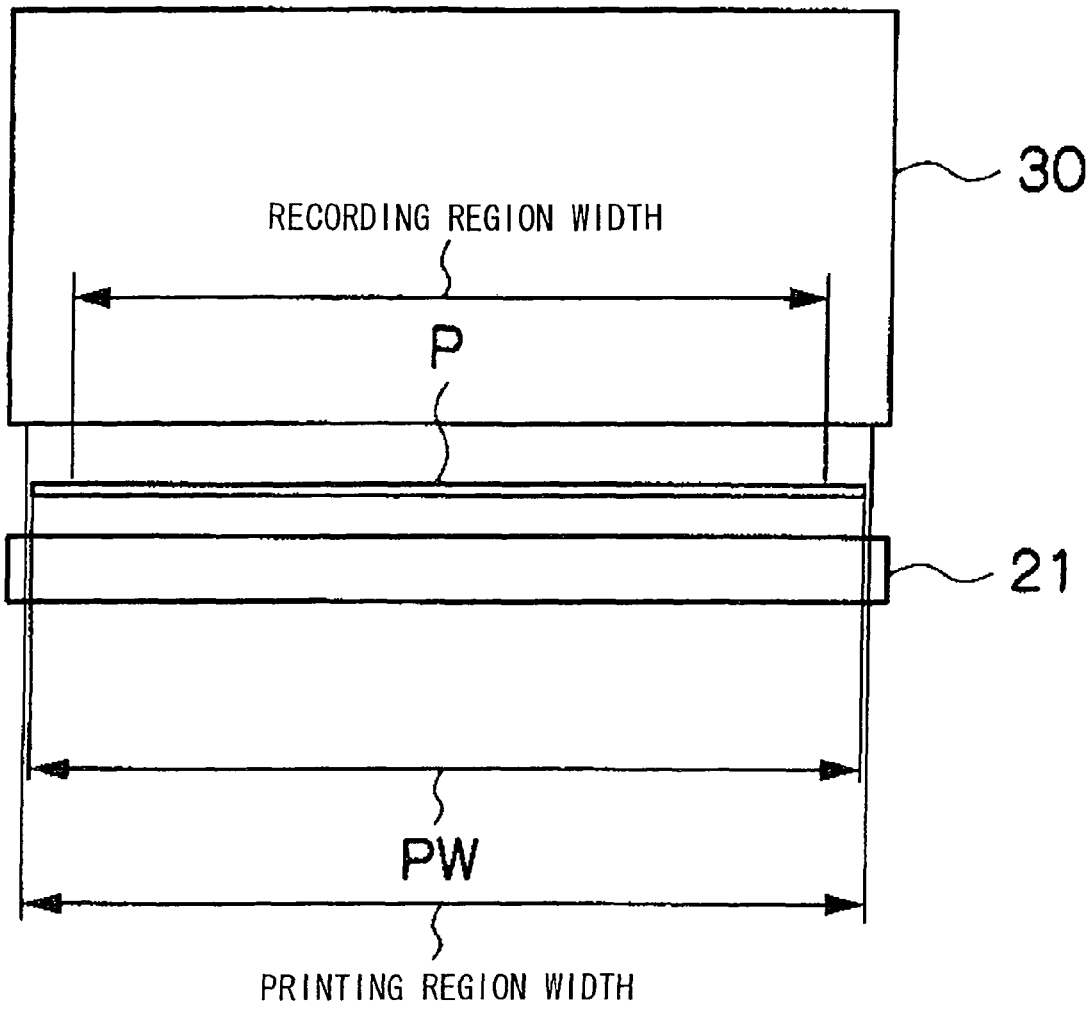
FIG. 3 is an explanatory drawing showing the relationship between the width of a recording medium and the width of a printing region relating to the present exemplary embodiment.

As shown in FIG. 3, the width of the printing region by the nozzles 56 of each inkjet recording unit 30 is longer than a maximum sheet width PW of the recording sheet P for which image recording at the inkjet recording device 10 is supposed, such that image recording over the entire width of the recording sheet P is possible without moving the inkjet recording unit 30 in the transverse direction of the sheet.

Here, the basic printing region width is the maximum width among recording regions which are formed by subtracting margins, at which printing is not carried out, from the both ends of the recording sheet P, and generally, is larger than the maximum sheet width PW which is the object of printing. This is because there is the concern that the recording sheet P will be conveyed while inclined at a predetermined angle with respect to the conveying direction, and because the demand for borderless printing is high.

Figure 4:
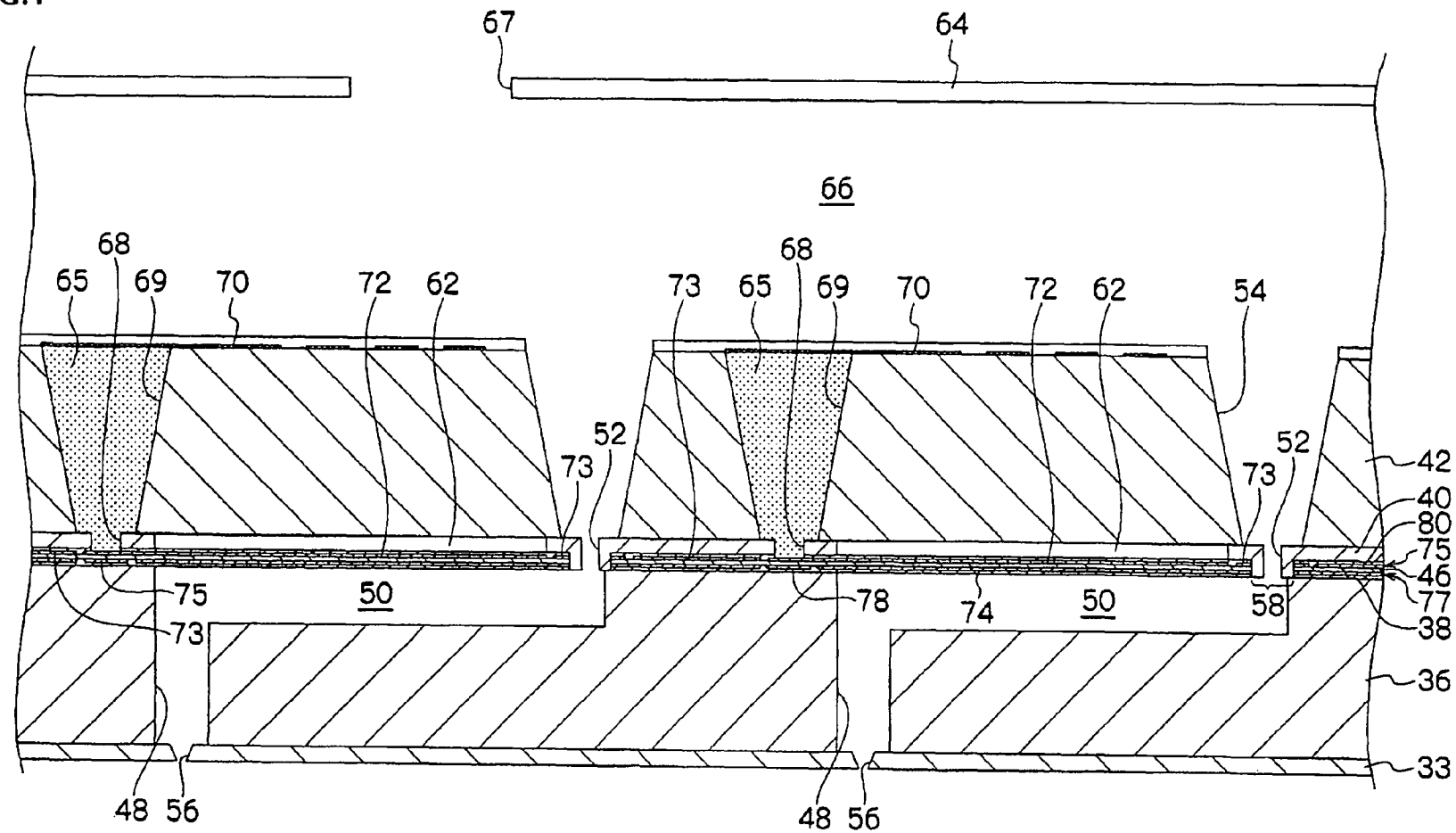
FIG. 4 is a schematic vertical portional view in which the inkjet recording head relating to the present exemplary embodiment is shown with portions thereof removed in order for the main portions thereof to be clear.

Structure of Inkjet Recording Head 32 Relating to Present Exemplary Embodiment Next, the structure of the inkjet recording head 32 relating to the present exemplary embodiment will be described. FIG. 4 is a schematic vertical sectional view in which the inkjet recording head 32 relating to the present exemplary embodiment is shown with portions thereof removed in order for the main portions thereof to be clear.

As shown in FIG. 4, the inkjet recording head 32 relating to the present exemplary embodiment has a nozzle plate 33, a flow path formation plate 36, a vibrating plate 38, a piezoelectric body 46, a supply path plate 40, and a top plate 42. The nozzle plate 33, the flow path formation plate 36, the vibrating plate 38, the piezoelectric body 46, the supply path plate 40, and the top plate 42 are layered in this order.

The plural nozzles 56 which eject ink droplets are formed in the nozzle plate 33. The nozzles 56 are arranged in a two-dimensional form at predetermined intervals (see FIG. 2).

First passages 48, whose diameters are larger than the nozzle diameters, are respectively formed at upward positions corresponding to the respective nozzles 56 of the nozzle plate 33, in the flow path formation plate 36 which is formed on the nozzle plate 33. The first passages 48 communicate with the nozzles 56, and ink can flow through from the first passages 48 to the nozzles 56

Pressure chambers 50, which are spaces of a predetermined size, are formed in the flow path formation plate 36 at positions upward of the first passages 48. One end portions of the pressure chambers 50 communicate with the first passages 48, and ink can flow through from the pressure chambers 50 to the first passages 48. In this way, the pressure chambers 50 communicate with the nozzles 56 via the first passages 43. Note that the pressure chambers 50 are arranged in a two-dimensional form in correspondence with the nozzles 56.

Figure 5:
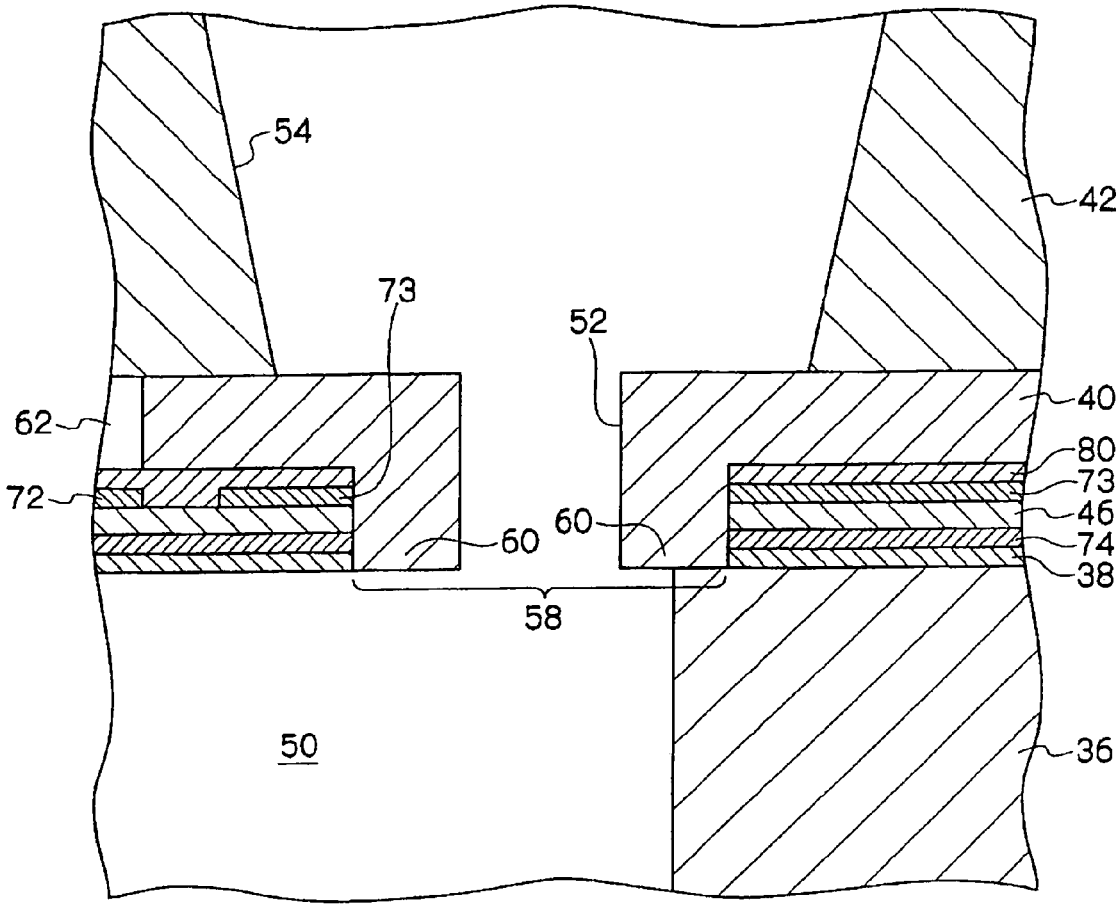
FIG. 5 is an enlarged view in which a supply path portion in FIG. 4 is enlarged.

The vibrating plate 38, which is formed on the flow path formation plate 36, closes the upper openings of the pressure chambers 50. By forming the upper walls of the pressure chambers 50, the vibrating plate 38 structures portions of the pressure chambers 50. Further, as shown in FIG. 5, through-holes 58 are respectively formed in the vibrating plate 38 at positions above the other end portions of the pressure chambers 50 of the flow path formation plate 36.

Figure 7:
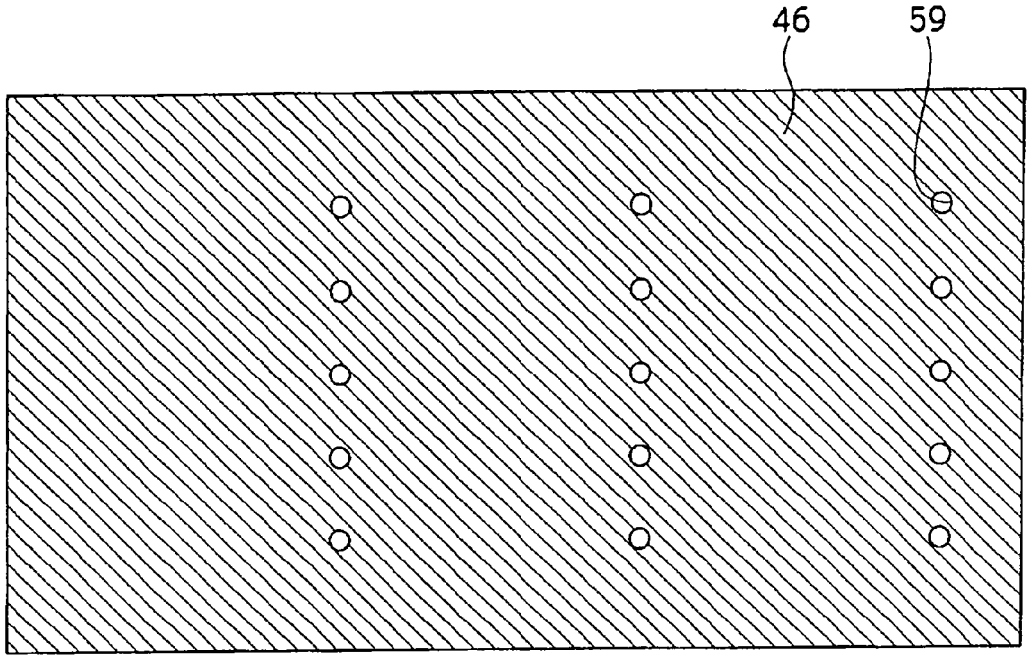
FIG. 7 is a drawing showing a formation pattern of a piezoelectric body relating to the present exemplary embodiment.

Through-holes 59, which communicate with the through-holes 58, are formed in correspondence with the through-holes 58 of the vibrating plate 38 in the piezoelectric body 46 which is formed above the vibrating plate 38 (see FIG. 7).

Figure 8:
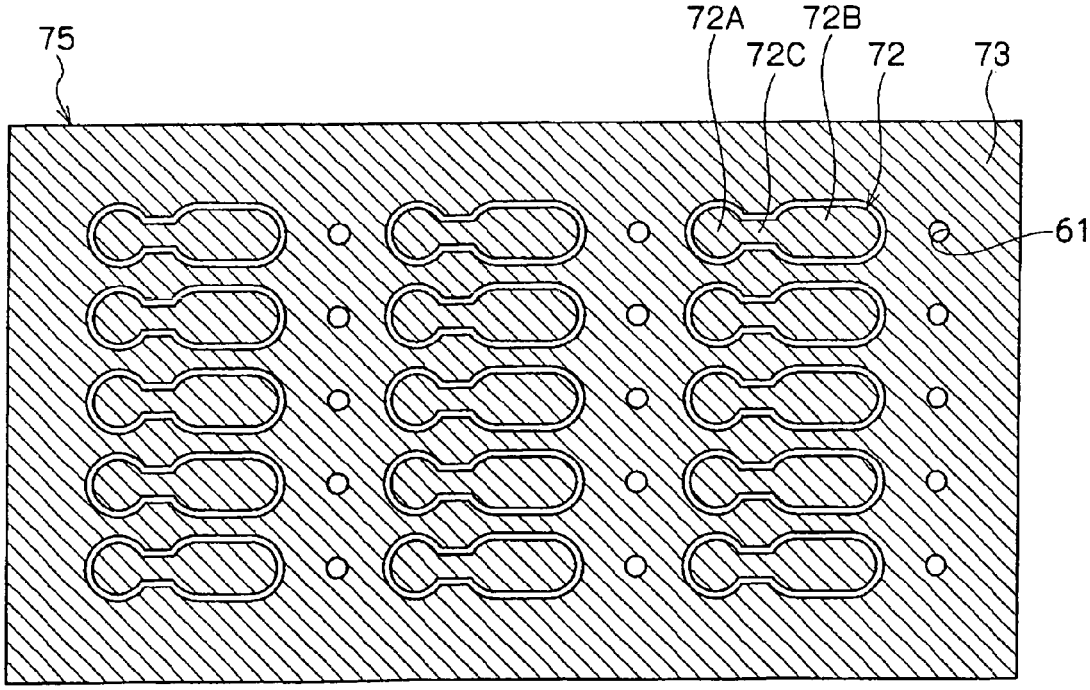
FIG. 8 is a drawing showing a formation pattern of an electrode layer which is formed on the top surface of the piezoelectric body relating to the present exemplary embodiment.

An electrode layer 75, which has individual electrodes 72 which are one polarity, is formed on the top surface of the piezoelectric body 46 (see FIG. 8). An electrode layer 77, which has a common electrode 74 which is the other polarity, is formed on the bottom surface of the piezoelectric body 46 (see FIG. 9). The electrode layer 77 has first electrode members 78, and the electrode layer 75 has a second electrode member 73. Details of the structures of the electrode layer 75 and the electrode layer 77 will be described later.

The individual electrodes 72 are formed individually for each of the pressure chambers 50, and are disposed above the respective pressure chambers 50. On the other hand, the common electrode 74 is formed integrally with respect to the plural pressure chambers 50, and is disposed so as to extend above the plural pressure chambers 50. Namely, the common electrode 74 is used as an electrode common to the plural pressure chambers 50.

The piezoelectric body 46 can displace the vibrating plate 38. The piezoelectric body 46 acquires electrical signals which serve as driving signals via the individual electrodes 72 and the common electrode 74, and is driven, and displaces the vibrating plate 38.

The piezoelectric body 46, the individual electrodes 72, and the common electrode 74 are covered and protected by a low water permeable insulating film (SiOx film) 80. Because the low water permeable insulating film (SiOx film) 80 is deposited under the condition that the moisture permeability decreases, moisture does not penetrate into the interior of the piezoelectric body 46.

Supply paths 52, whose diameters are smaller than the diameters of the through-holes 58 and the through-holes 59, are formed in the supply path plate 40 which is formed above the piezoelectric body 46, respectively at positions which are above the other end portions of the pressure chambers 50 of the flow path formation plate 36. Projecting portions 60, which project-out toward the vibrating plate 38 side, i.e., downward, are formed at the outer peripheral portions of the supply paths 52. The projecting portions 60 are structured so as to be fit into the through-holes 58 and the through-holes 59. The supply paths 52 communicate with the other end portions of the pressure chambers 50, and ink can be supplied from the supply paths 52 to the pressure chambers 50. Due to ink being supplied from the supply paths 52 to the pressure chambers 50, ink, which is to be ejected as ink droplets, is filled into the pressure chambers 50.

Space portions 62, which are spaces of a predetermined size, are formed in the supply path plate 40 above the pressure chambers 50.

Figure 6:
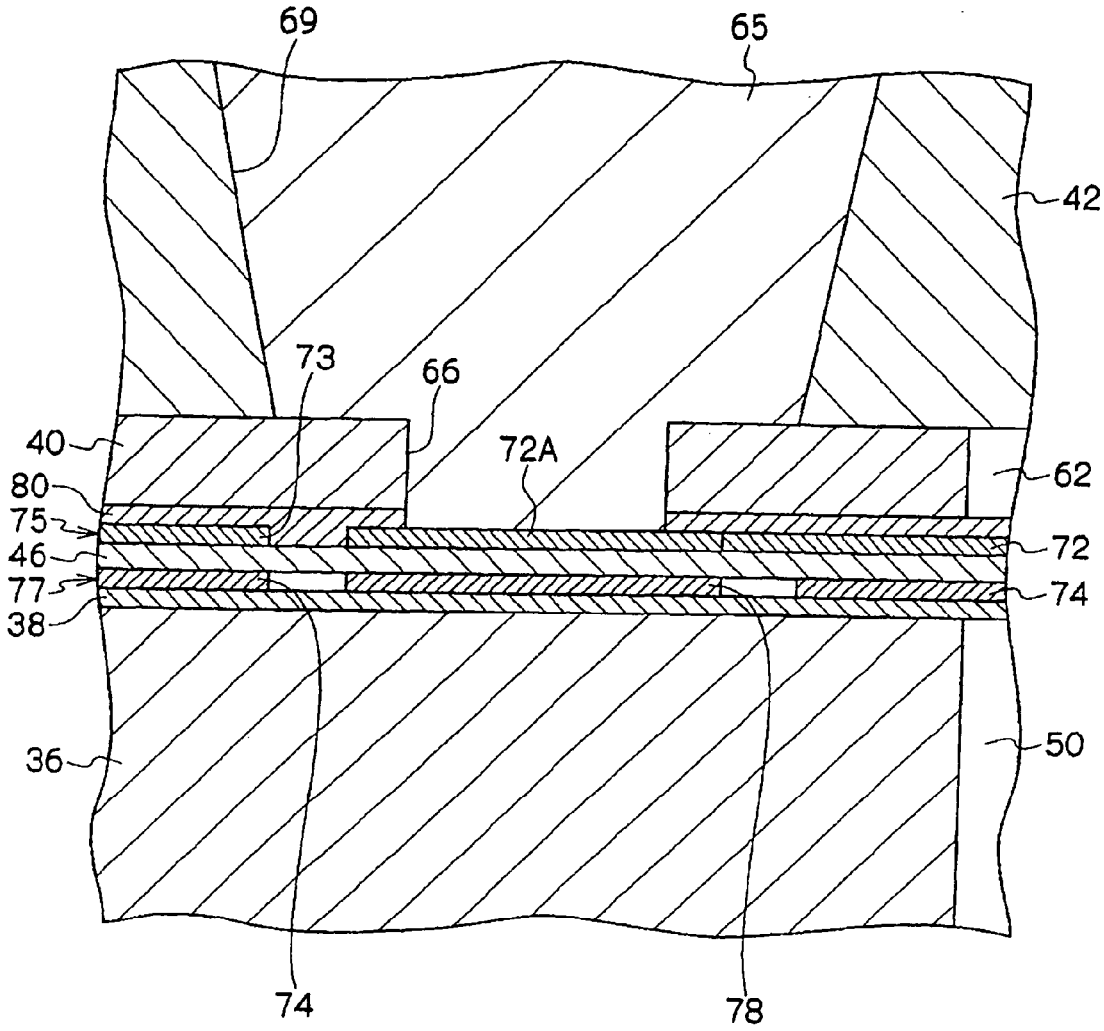
FIG. 6 is an enlarged view in which a portion, which electrically connects an individual electrode, in FIG. 4 is enlarged.

Further, as shown in FIG. 6, first electrical connection holes 68 are respectively formed in the supply path plate 40. The first electrical connection holes 68 are disposed at predetermined regions of the top surfaces of the individual electrodes 72. In the present exemplary embodiment, the first electrical connection holes 68 are disposed at the top surfaces of end portions 72A of the individual electrodes 72 which end portions 72A are formed in circular shapes (see FIG. 8).

Second passages 54, whose diameters are larger than the diameters of the supply paths 52, are respectively formed at upward positions corresponding to the respective supply paths 52 of the supply path plate 40, in the top plate 42 which is formed on the supply path plate 40. Namely, the passage surface areas of the supply paths 52 are narrower than those of the second passages 54. The second passages 54 communicate with the supply paths 52, and ink can flow through to the supply paths 52.

The inner wall surfaces of the second passages 54 are inclined from an ink storing chamber 66 toward the supply path plate 40, such that the second passages 54 are formed in tapered shapes whose diameters gradually decrease from top to bottom.

Second electrical connection holes 69, which are formed as circular through-holes whose diameters are larger than the diameters of the first electrical connection holes 68, are formed in the top plate 42 respectively at upward positions corresponding to the respective first electrical connection holes 68 of the supply path plate 40. The second electrical connection holes 69 have the same shape as the second passages 54.

Wiring patterns 70 are formed on the top surface of the top plate 42. One end portions of the wiring patterns 70 are electrically connected to electrically-conductive materials 65 which are an example of electrical connection portions.

The electrically-conductive materials 65 are formed as a paste, and are filled into the first electrical connection holes 68 and the second electrical connection holes 69. The top portions of the electrically-conductive materials 65 contact the wiring patterns 70, and the electrically-conductive materials 65 and the wiring patterns 70 are electrically connected.

The end portions 72A of the individual electrodes 72 contact the bottom portions of the electrically-conductive materials 65, and the electrically-conductive materials 65 and the individual electrodes 72 are electrically connected.

The other end portions of the wiring patterns 70 are electrically connected to an unillustrated driving IC. The common electrode 74 is electrically connected to the driving IC via an unillustrated signal wire.

The driving IC acquires control signals from the exterior, and, on the basis of these control signals, sends electrical signals serving as driving signals to the piezoelectric bodies 46, and drives the respective piezoelectric bodies 46 at predetermined timings respectively.

The electrical signal is applied to the piezoelectric body 46, and the piezoelectric body 46 displaces the vibrating plate 38 so as to decrease the volumes within the pressure chambers 50, and applies pressure to the pressure chambers 50. In this way, ink travels from the pressure chambers 50 via the first passages 48 to the nozzles 56, and ink droplets are ejected from the nozzles 56.

A storing chamber member 64, which is formed of an ink-resistant material, is adhered to the top plate 42. The ink storing chamber 66, which has a predetermined shape and volume, is formed between the storing chamber member 64 and the top plate 42. An ink supply port 67, which communicates with an ink tank (not shown), is formed at a predetermined place in the storing chamber member 64. Ink which is poured-in from the ink supply port 67 is stored in the ink storing chamber 66.

Structures of Electrode Layer 75 and Electrode Layer 77 Which are Formed at the Piezoelectric Body 46

The structures of the electrode layer 75 and the electrode layer 77 which are formed at the piezoelectric body 46 will be described next.

Figure 9:
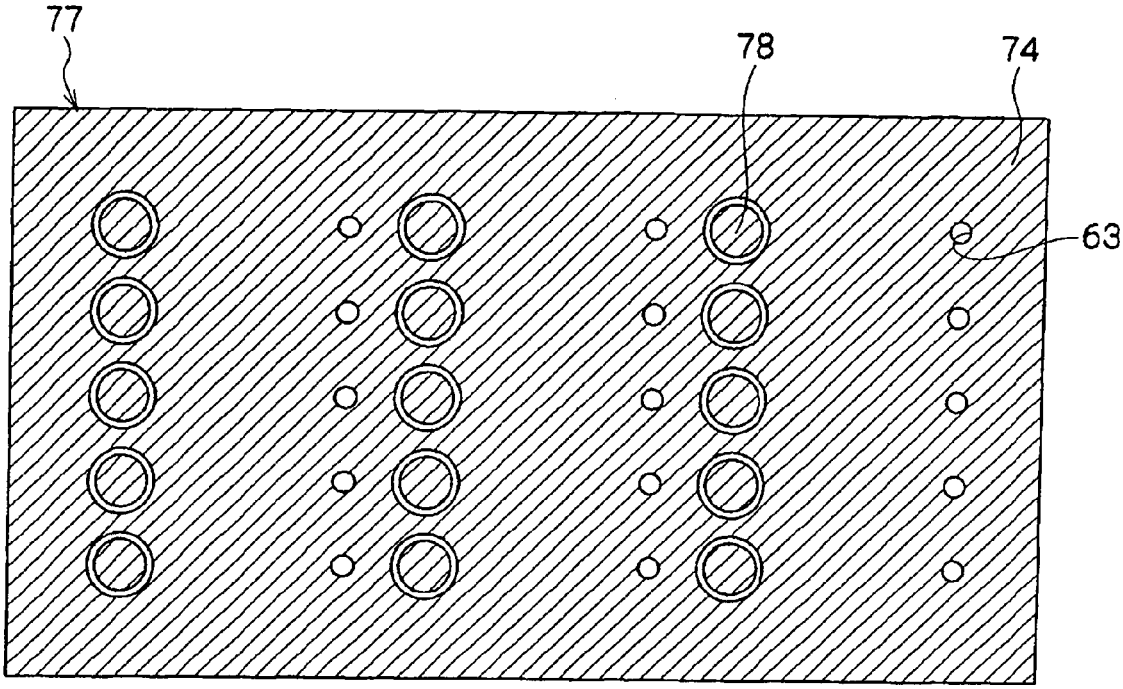
FIG. 9 is a drawing showing a formation pattern of an electrode layer which is formed on the bottom surface of the piezoelectric body relating to the present exemplary embodiment.

A formation pattern of the piezoelectric body 46 is shown in FIG. 7. A formation pattern of the electrode layer 75 is shown in FIG. 8. A formation pattern of the electrode layer 77 is shown in FIG. 9.

In the present exemplary embodiment, the electrode layer 75 is formed on the top surface of the piezoelectric body 46. Namely the formation pattern of FIG. 8 is formed on the top surface of the formation pattern of FIG. 7.

Further, the electrode layer 77 is formed on the bottom surface of the piezoelectric body 46. Namely, the formation pattern of FIG. 9 is formed on the bottom surface of the formation pattern of FIG. 7.

As shown in FIG. 7, the plural through-holes 59, which communicate with the through-holes 58 of the vibrating plate 38, are formed in the piezoelectric body 46. The through-holes 59 are arranged in a two-dimensional form.

As shown in FIG. 8, the electrode layer 75, which is formed on the top surface of the piezoelectric body 46, has the individual electrodes 72 which are one polarity and the second electrode member 73 which is electrically isolated from the individual electrodes 72.

Due to gaps being formed between the individual electrodes 72 and the second electrode member 73, the second electrode member 73 is detached from the individual electrodes 72 and is separated from the individual electrodes 72.

Further, through-holes 61, which communicate with the through-holes 59, are formed in the second electrode member 73 in correspondence with the through-holes 59 of the piezoelectric body 46. The through-holes 61 are arranged in a two-dimensional form in correspondence with the through-holes 59.

The individual electrodes 72 are formed individually for each of the pressure chambers 50 which are arranged in a two-dimensional form, and are disposed above the respective pressure chambers 50. Further, one end portion of the individual electrode 72 is formed in a circular shape, and the other end portion is formed in an elliptical shape. The end portion 72A which is formed in a circular shape and an end portion 72B which is formed in an elliptical shape are connected by a connecting portion 72C.

The electrically-conductive materials 65, which are one example of electrical connecting portions, contact the top surfaces of the circular end portions 72A of the individual electrodes 72, and the individual electrodes 72 are electrically connected to the electrically-conductive materials 65.

The end portions 72B which are formed in elliptical shapes are disposed above the pressure chambers 50. The end portions 72A are disposed at positions which are offset from above the pressure chambers 50. The end portions 72B are driven by electrical signals, which are sent from the electrically-conductive materials 65 via the end portions 72A and the connecting portions 72C, and displace the vibrating plate 38 and apply pressure to the pressure chambers 50. On the other hand, electrical signals are not applied to the second electrode member 73 which is separated from the individual electrodes 72, and the portion of the piezoelectric body 46 at which the second electrode member 73 is formed is a non-driven region. Here, "non-driven region" also means that it does not become parasitic capacitance.

Note that the shape of the individual electrode 72 can be formed arbitrarily, and the shape of the end portion 72A is not limited to a circular shape, and the shape of the end portion 72B is not limited to an elliptical shape.

As shown in FIG. 9, the electrode layer 77 which is formed on the bottom surface of the piezoelectric body 46 has the common electrode 74 which is the other polarity, and the first electrode members 78 which are electrically isolated from the common electrode 74.

Due to gaps being formed between the common electrode 74 and the first electrode members 78, the first electrode members 78 are detached from the common electrode 74 and are separated from the common electrode 74.

Further, a plurality of through-holes 63, which communicate with the through-holes 59, are formed in the common electrode 74 in correspondence with the through-holes 59 of the piezoelectric body 46. The projecting portions 60 of the supply path plate 40 are structured so as to be fit into the through-holes 58 of the vibrating plate 38, the through-holes 59 of the piezoelectric body 46, the through-holes 61 of the electrode layer 75, and the through-holes 63 of the electrode layer 77. The through-holes 63 are arranged in a two-dimensional form in correspondence with the through-holes 59.

The first electrode members 78 are disposed at the side opposite the side at which the end portions 72A of the individual electrodes 72 are located (see FIG. 6), with the piezoelectric body 46 sandwiched therebetween. Similarly to the end portions 72A of the individual electrodes 72, the first electrode members 78 are formed in circular shapes, and are disposed at positions which are directly beneath the end portions 72A. Note that the shapes of the first electrode members 78 do not have to be circular. Further, the first electrode members 78 do not have to be disposed at positions directly beneath the end portions 72A, and may be disposed at positions which are offset from positions directly beneath the end portions 72A.

The first electrode members 78 are separated from the common electrode 74. The portions of the piezoelectric body 46 at which the first electrode members 78 are formed are non-driven regions. Namely, these portions do not become parasitic capacitance.

Here, an example of a method of forming the electrode layer 75 and the electrode layer 77 will be described.

The electrode layer 77 is formed by an Au film for example, on the top surface of the vibrating plate 38 by sputtering. The electrode layer 77, which is formed on the top surface of the vibrating plate 38, is patterned, and is separated into the common electrode 74 and the first electrode members 78. Specifically, this is resist formation by photolithography, patterning, etching by RIE, and resist removal by oxygen plasma.

A PZT film which is the material of the piezoelectric body 46, and an Au film which becomes the electrode layer 75, are layered in that order by sputtering on the top surfaces of the individual electrodes 72, and the piezoelectric body 46 and the electrode layer 75 are patterned, and the electrode layer 75 is divided into the individual electrodes 72 and the second electrode member 73. Specifically, this is sputtering of the PZT film, sputtering of the Au film, resist formation by photolithography, patterning (etching), and resist removal by oxygen plasma. Examples of the electrode materials of the electrode layer 75 and the electrode layer 77 are Au, Ir, Ru, Pt, and the like which are heat-resistant and have a high affinity with the PZT material which is the piezoelectric body 46.

In this way, the individual electrodes 72 and the second electrode member 73 are both formed at the electrode layer 75, and are formed on the top surface of the piezoelectric body 46. Namely, the individual electrodes 72 and the second electrode member 73 are both the same layer, and are formed on the same surface. Further, the individual electrodes 72 and the second electrode member 73 are formed of the same material in the same process. Note that a structure may be used in which the individual electrodes 72 and the second electrode member 73 are formed of separate materials in separate processes.

The common electrode 74 and the first electrode members 78 are both formed at the electrode layer 77, and are formed on the bottom surface of the piezoelectric body 46. Namely, the common electrode 74 and the first electrode members 78 are both the same layer, and are formed on the same surface. Further, the common electrode 74 and the first electrode members 78 are formed of the same material in the same process. Note that a structure may be used in which the common electrode 74 and the first electrode members 78 are formed of separate materials in separate processes.

Operation of Inkjet Recording Head Relating to Present Exemplary Embodiment

Operation of the inkjet recording head relating to the present exemplary embodiment will be described next.

In accordance with the structure of the present exemplary embodiment, the driving IC sends electrical signals which serve as driving signals to the piezoelectric bodies 46, and drives the respective piezoelectric bodies 46 at predetermined timings respectively.

The electrical signal is applied to the piezoelectric body 46, and the piezoelectric body 46 displaces the vibrating plate 38 so as to decrease the volumes within the pressure chambers 50, and applies pressure to the pressure chambers 50. In this way, ink travels from the pressure chambers 50 via the first passages 48 to the nozzles 56, and ink droplets are ejected from the nozzles 56.

Here, in the structure of the present exemplary embodiment, because the first electrode members 78 are electrically isolated from the common electrode 74, the regions of the piezoelectric body 46 which are sandwiched between the first electrode members 78 and the end portions 72A of the individual electrodes 72, i.e., regions of the piezoelectric body 46 in vicinities of the end portions 72A which contact the electrically-conductive materials 65, are not driven, and the regions of the piezoelectric body 46 above the pressure chambers 50 are driven.

In this way, by driving the regions of the piezoelectric body 46 which are above the pressure chambers 50 without driving the piezoelectric body 46 in vicinities of the end portions 72A of the individual electrodes 72, regions of the vibrating plate 38, which regions decrease the volumes within the pressure chambers 50 and contribute to the ejecting of ink droplets from the nozzles 56, are displaced.

Note that the positions where the first electrode members 78, which are separated from the common electrode 74, are disposed are not limited to positions which are directly beneath the end portions 72A of the individual electrodes 72. The first electrode members 78 may be disposed at positions, which are at the side opposite the side at which the end portions 72A are disposed with the piezoelectric body 46 sandwiched therebetween and which are offset from the portions above the pressure chambers 50, i.e., may be disposed at positions which do not contribute to the ejecting of ink droplets even if the piezoelectric body 46 is driven.

Further, in the above-described exemplary embodiment, the ink storing chamber 66 is disposed above the piezoelectric body 46, and the pressure chambers 50 and the nozzles 56 are disposed beneath the piezoelectric body 46. Namely, this is a structure in which the ink storing chamber 66 is disposed at one side, whereas the pressure chambers 50 and nozzles 56 are disposed at the other side, with the piezoelectric body 46 sandwiched therebetween. However, the present invention is not limited to this structure, and may be, for example, a structure in which the ink storing chamber 66, the pressure chambers 50 and the nozzles 56 are disposed at one side of the piezoelectric body 46, e.g., the lower side of the piezoelectric body 46.

Figure 10:
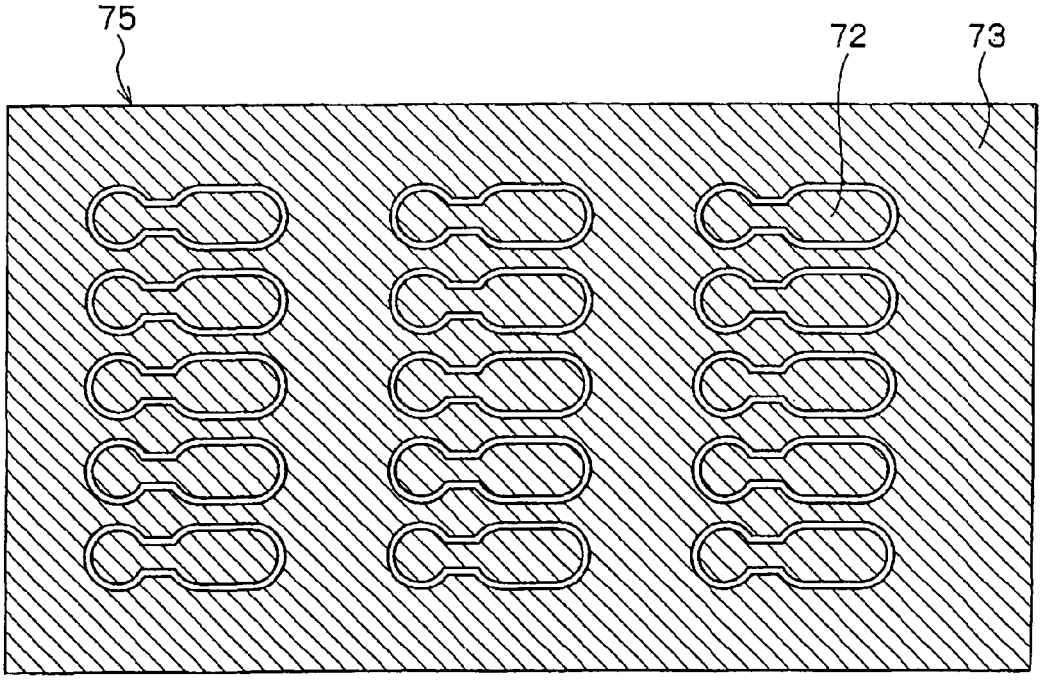
FIG. 10 is a drawing showing a modified example of a formation pattern of an electrode layer which is formed on the top surface of the piezoelectric body relating to the present exemplary embodiment.

In a structure in which the ink storing chamber 66 is disposed at one side and the pressure chambers 50 and nozzles 56 are disposed at the other with the piezoelectric body 46 sandwiched therebetween, flow paths which pass through the piezoelectric body 46 must be formed, such as the supply paths 52 relating to the present exemplary embodiment. In contrast, in a structure in which the ink storing chamber 66, the pressure chambers 50 and the nozzles 56 are disposed at one side of the piezoelectric body 46, because there is no need to form flow paths which pass through the piezoelectric body 46, there is no need to form through-holes in the electrode layer 75 which has the individual electrodes 72, as shown in FIG. 10.

Figure 11:
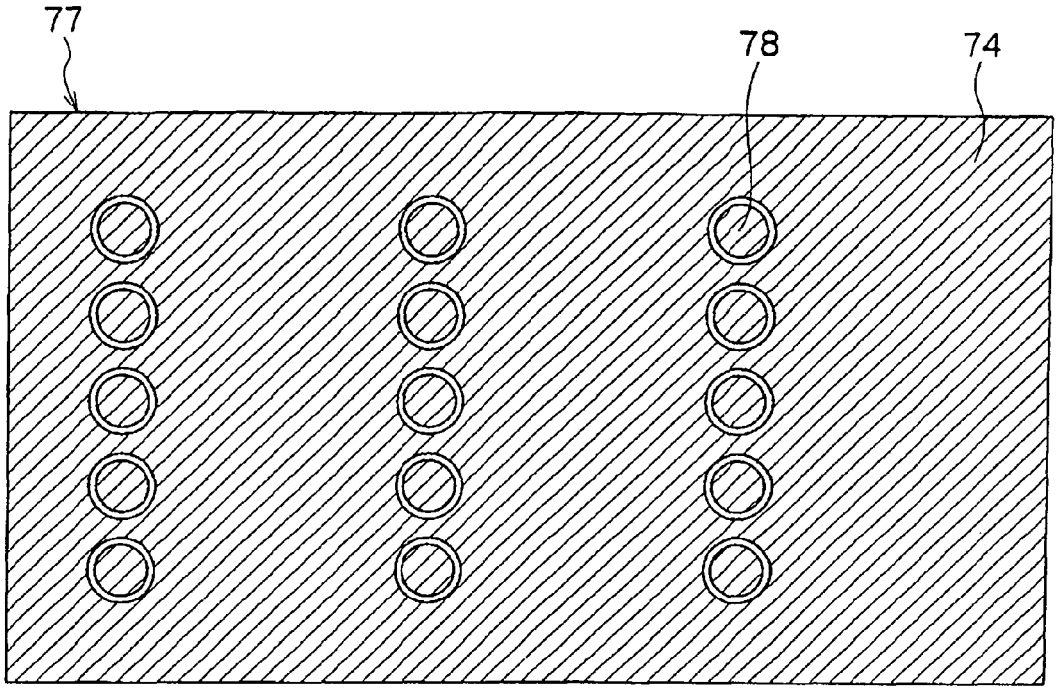
FIG. 11 is a drawing showing a modified example of a formation pattern of an electrode layer which is formed on the bottom surface of the piezoelectric body relating to the present exemplary embodiment.

Further, as shown in FIG. 11, there is no need to form through-holes in the electrode layer 77 which has the common electrode 74.

Modified Example Changing the Arrangement of the Individual Electrodes 72 and the Common Electrode 74

A modified example, in which the arrangement of the individual electrodes 72 and the common electrode 74 is changed, will be described next.

In the above-described exemplary embodiment, the individual electrodes 72 are disposed on the top surface of the piezoelectric body 46, and the common electrode 74 is disposed at the bottom surface of the piezoelectric body 46. However, the present modified example is structured such that the common electrode 74 is disposed on the top surface of the piezoelectric body 46, and the individual electrodes 72 are disposed at the bottom surface of the piezoelectric body 46.

Figure 12:
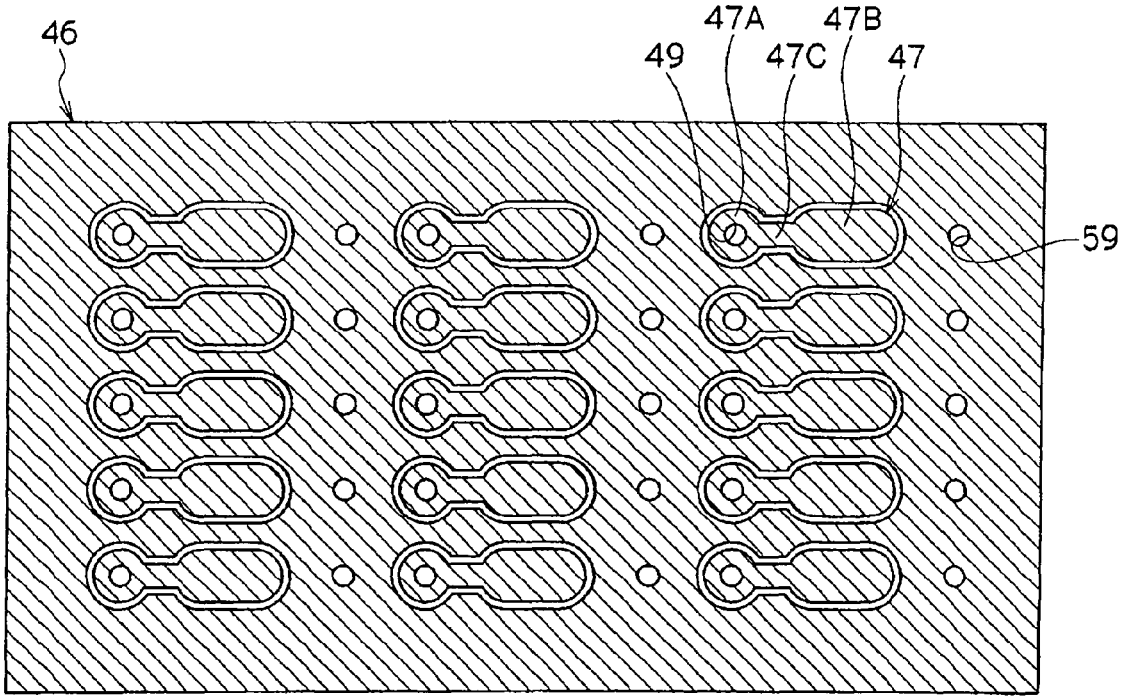
FIG. 12 is a drawing showing a formation pattern of the piezoelectric body in a modified example in which the arrangement of individual electrodes and a common electrode is changed.
Figure 13:
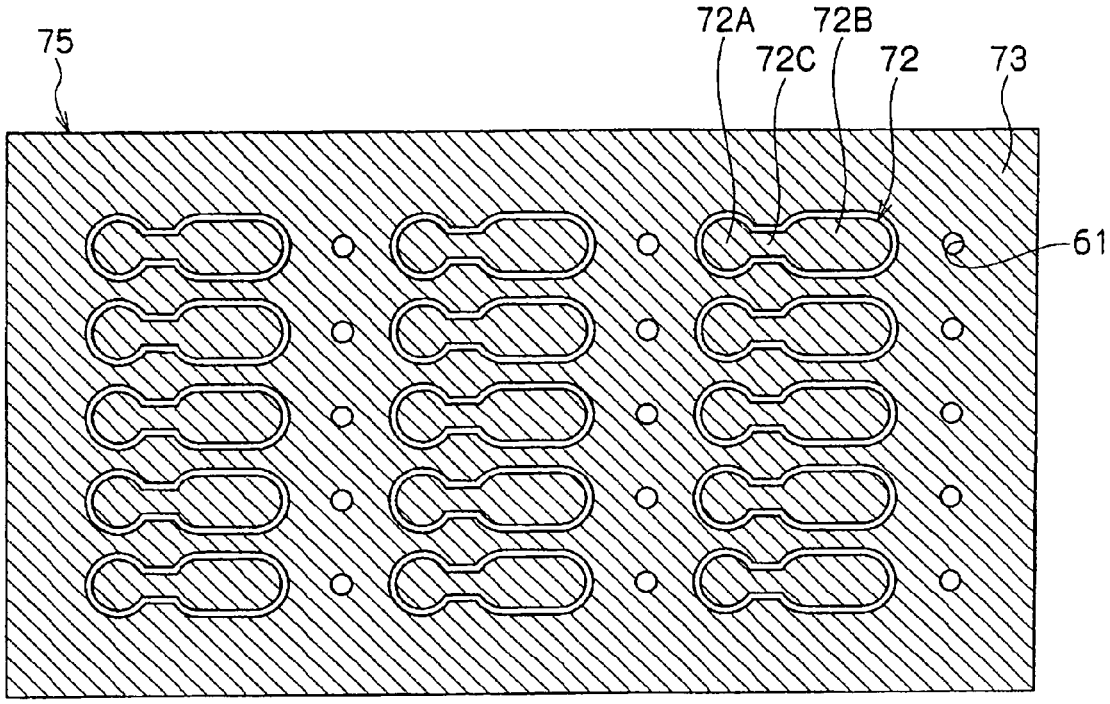
FIG. 13 is a drawing showing a formation pattern of an electrode layer which is formed on the top surface of the piezoelectric body, in the modified example in which the arrangement of the individual electrodes and the common electrode is changed.
Figure 14:
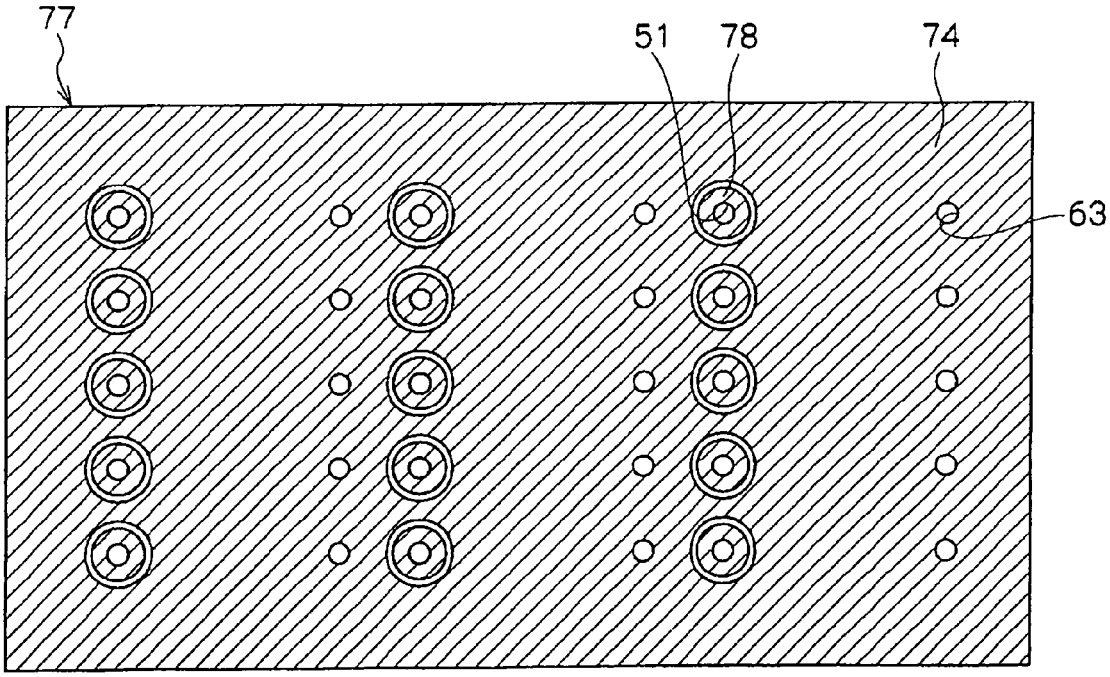
FIG. 14 is a drawing showing a formation pattern of an electrode layer which is formed on the bottom surface of the piezoelectric body, in the modified example in which the arrangement of the individual electrodes and the common electrode is changed.

A formation pattern of the piezoelectric body 46 is shown in FIG. 12. A formation pattern of the electrode layer 75 which has the individual electrodes 72 is shown in FIG. 13. A formation pattern of the electrode layer 77 which has the common electrode 74 is shown in FIG. 14.

In the present modified example, the electrode layer 75, which has the individual electrodes 72 which are one polarity, is formed on the bottom surface of the piezoelectric body 46. Namely, the formation pattern of FIG. 13 is formed on the bottom surface of the formation pattern of FIG. 12.

In the present modified example, the electrode layer 77, which has the common electrode 74 which is the other polarity, is formed on the top surface of the piezoelectric body 46. Namely, the formation pattern of FIG. 14 is formed on the top surface of the formation pattern of FIG. 12.

As shown in FIG. 12, the plurals through-holes 59, which communicate with the through-holes 58 of the vibrating plate 38, are formed in the piezoelectric body 46. The through-holes 59 are arranged in a two-dimensional form.

The piezoelectric body 46 has separated piezoelectric bodies 47 which are separated per pressure chamber 50. The separated piezoelectric bodies 47 are disposed above the respective pressure chambers 50 which are arranged in a two-dimensional form. One end portion of the separated piezoelectric body 47 is formed in a circular shape, and the other end portion is formed in an elliptical shape. An end portion 47A which is formed in a circular shape and an end portion 47B which is formed in an elliptical shape are connected by a connecting portion 47C.

At the separated piezoelectric bodies 47, the end portions 47B which are formed in elliptical shapes are disposed above the pressure chambers 50, and the end portions 47A are disposed at positions which are offset from above the pressure chambers 50. Further, through-holes 49 are formed in the end portions 47A which are formed in circular shapes.

Note that the shape of the separated piezoelectric body 47 can be formed arbitrarily, and the shape of the end portion 47A is not limited to a circular shape, and the shape of the end portion 47B is not limited to an elliptical shape.

As shown in FIG. 13, the electrode layer 75, which is formed on the bottom surface of the piezoelectric body 46, has the individual electrodes 72 which are one polarity, and the second electrode member 73 which is electrically isolated from the individual electrodes 72.

Due to gaps being formed between the individual electrodes 72 and the second electrode member 73, the second electrode member 73 is detached from the individual electrodes 72 and is separated from the individual electrodes 72.

Further, the through-holes 61, which communicate with the through-holes 59, are formed in the second electrode member 73 in correspondence with the through-holes 59 of the piezoelectric body 46. The through-holes 61 are arranged in a two-dimensional form in correspondence with the through-holes 59.

The individual electrodes 72 are formed individually for each of the pressure chambers 50 which are arranged in a two-dimensional form, and are disposed on the respective separated piezoelectric bodies 47. One end portion of the individual electrode 72 is formed in a circular shape, and the other end portion is formed in an elliptical shape. The end portion 72A which is formed in a circular shape and the end portion 72B which is formed in an elliptical shape are connected by the connecting portion 72C.

The end portion 72A of the individual electrode 72 is disposed on the end portion 47A of the separated piezoelectric body 47, the end portion 72B is disposed on the end portion 47B of the separated piezoelectric body 47, and the connecting portion 72C is disposed on the connecting portion 47C of the separated piezoelectric body 47.

The electrically-conductive materials 65, which are one example of electrical connecting portions, contact the top surfaces of the circular end portions 72A of the individual electrodes 72, and the individual electrodes 72 are electrically connected to the electrically-conductive materials 65.

The end portions 72B which are formed in elliptical shapes are driven by electrical signals, which are sent from the electrically-conductive materials 65 via the end portions 72A and the connecting portions 72C, and displace the vibrating plate 38 and apply pressure to the pressure chambers 50. On the other hand, the second electrode member 73 is separated from the individual electrodes 72, and the portion of the piezoelectric body 46 at which the second electrode member 73 is formed is a non-driven region.

Note that the shape of the individual electrode 72 can be formed arbitrarily, and the shape of the end portion 72A is not limited to a circular shape, and the shape of the end portion 72B is not limited to an elliptical shape.

As shown in FIG. 14, the electrode layer 77 which is formed on the top surface of the piezoelectric body 46 has the common electrode 74 which is the other polarity, and the first electrode members 78 which are electrically isolated from the common electrode 74.

Due to gaps being formed between the common electrode 74 and the first electrode members 78, the first electrode members 78 are detached from the common electrode 74 and are separated from the common electrode 74.

Further, the plural through-holes 63, which communicate with the through-holes 59, are formed in the common electrode 74 in correspondence with the through-holes 59 of the piezoelectric body 46. The projecting portions 60 of the supply path plate 40 are structured so as to be fit into the through-holes 58 of the vibrating plate 38, the through-holes 59 of the piezoelectric body 46, the through-holes 61 of the electrode layer 75, and the through-holes 63 of the electrode layer 77. The through-holes 63 are arranged in a two-dimensional form in correspondence with the through-holes 59.

The first electrode members 78 are disposed at the side opposite the side at which the end portions 72A of the individual electrodes 72 are located (see FIG. 15), with the piezoelectric body 46 sandwiched therebetween. Similarly to the end portions 72A of the individual electrodes 72, the first electrode members 78 are formed in circular shapes, and are disposed at positions which are directly above the end portions 72A.

Note that the shapes of the first electrode members 78 do not have to be circular. Further, the first electrode members 78 do not have to be disposed at positions directly above the end portions 72A, and may be disposed at positions which are offset from positions directly above the end portions 72A.

Figure 15:
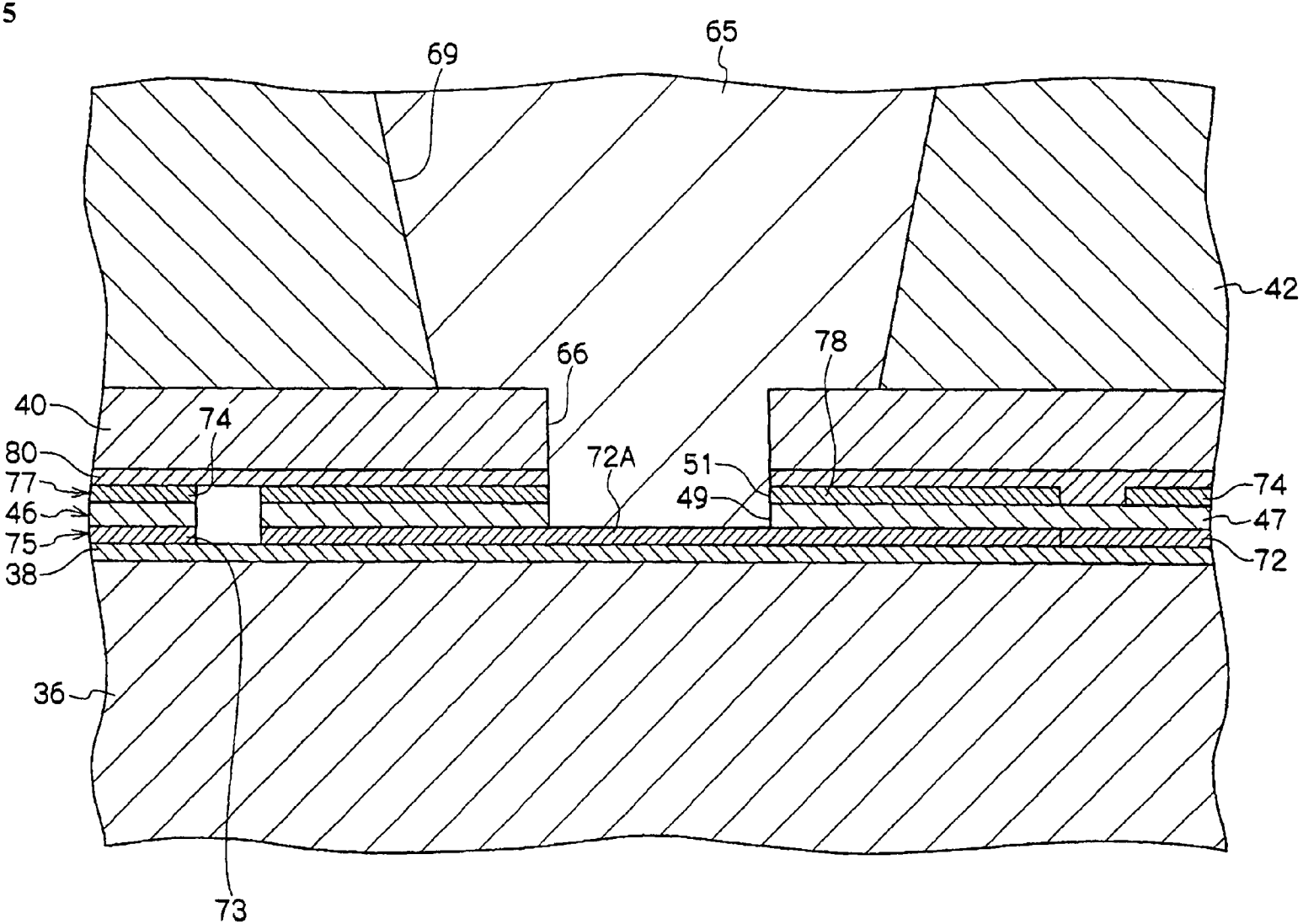
FIG. 15 is an enlarged drawing in which a portion, which electrically connects an individual electrode in the modified example in which the arrangement of the individual electrodes and the common electrode is changed, is enlarged.
Figure 16:
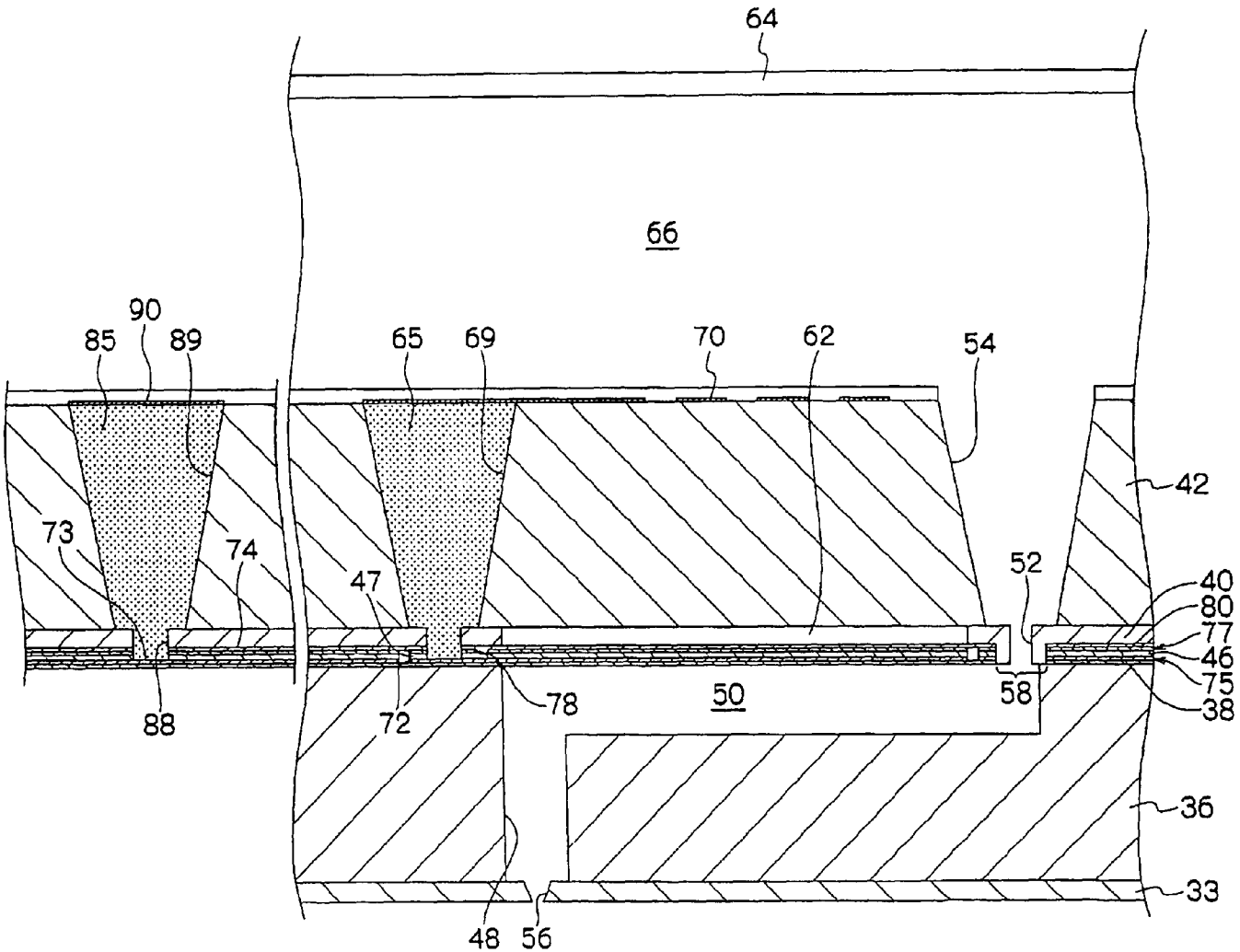
FIG. 16 is a schematic vertical sectional view in which an inkjet recording head, in the modified example in which the arrangement of the individual electrodes and the common electrode is changed, is shown with portions thereof removed in order for the main portions thereof to be clear.

Through-holes 51, which communicate with the through-holes 49, are formed in the first conductive members 78 in correspondence with the through-holes 49 of the separated piezoelectric bodies 47. As shown in FIG. 15 and FIG. 16, the electrically-conductive materials 65 are filled into the through-holes 51 and the through-holes 49 of the separated piezoelectric bodies 47, and the electrically-conductive materials 65 pass-through from the top surface side of the piezoelectric body 46 to the bottom surface side of the piezoelectric body 46. In this way, the bottom portions of the electrically-conductive materials 65 contact the end portions 72A of the individual electrodes 72, and the electrically-conductive materials 65 and the individual electrodes 72 are electrically connected.

Due to the electrically-conductive materials 65, which are filled in the through-holes 51 of the first electrode members 78 and the through-holes 49 of the separated piezoelectric bodies 47, the individual electrodes 72 are electrically connected to the first electrode members 78, and the individual electrodes 72 and the first electrode members 78 are made to be the same potential.

Further, the first electrode members 78 are separated from the common electrode 74, and the portions of the piezoelectric body 46 at which the first electrode members 78 are formed are non-driven regions.

In this way, the individual electrodes 72 and the second electrode member 73 are both formed at the electrode layer 75, and are formed on the bottom surface of the piezoelectric body 46. Namely, the individual electrodes 72 and the second electrode member 73 are both the same layer, and are formed on the same surface.

The common electrode 74 and the first electrode members 78 are both formed at the electrode layer 77, and are formed on the top surface of the piezoelectric body 46. Namely, the common electrode 74 and the first electrode members 78 are both the same layer, and are formed on the same surface.

Note that the piezoelectric body 46, the electrode layer 75, and the electrode layer 77 are formed by the methods similar to those of the above-described exemplary embodiment.

Further, as shown in FIG. 16, the common electrode 74 and the second electrode member 73 are electrically connected. In the present modified example, in the same way as the individual electrodes 72 and the first electrode members 78 are connected, the common electrode 74 and the second electrode member 73 are electrically connected by electrically-conductive materials 85, which are filled into first electrical connection holes 88 formed in the supply path plate 40 and second electrical connection holes 89 formed in the top plate 42.

The top portions of the electrically-conductive materials 85 contact one end portions of wiring patterns 90 which are formed at the top plate 42, and the electrically-conductive materials 85 and the wiring patterns 90 are electrically connected. The other end portions of the wiring patterns 90 are electrically connected to an unillustrated driving IC, and the common electrode 74 and the driving IC are electrically connected.

In accordance with the structure of the present modified example, the first electrode members 78 are electrically isolated from the common electrode 74. Therefore, the regions of the piezoelectric body 46 which are sandwiched between the first electrode members 78 and the end portions 72A of the individual electrodes 72 (the two-dot chain line portion A in FIG. 17A and FIG. 17B), i.e., the regions of the piezoelectric body 46 in vicinities of the end portions 72A which contact the electrically-conductive materials 65, are not driven, whereas the regions of the piezoelectric body 46 which are above the pressure chambers 50 (the two-dot chain line portions B in FIG. 17A and FIG. 17B) are driven.

In this way, due to the regions of the piezoelectric body 46 which are above the pressure chambers 50 being driven without the regions of the piezoelectric body 46 which are in vicinities of the end portions 72A of the individual electrodes 72 being driven, at the vibrating plate 38, the regions which reduce the volumes within the pressure chambers 50 and contribute to the ejecting of ink droplets from the nozzles 56, are displaced.

Note that the positions where the first electrode members 78, which are separated from the common electrode 74, are disposed are not limited to positions which are directly above the end portions 72A of the individual electrodes 72. The first electrode members 78 may be disposed at positions, which are at the side opposite the side at which the end portions 72A are located with the piezoelectric body 45 sandwiched therebetween and which are offset from the portions above the pressure chambers 50, i.e., may be disposed at positions which do not contribute to the ejecting of ink droplets even if the piezoelectric body 46 is driven.

Figure 17A:
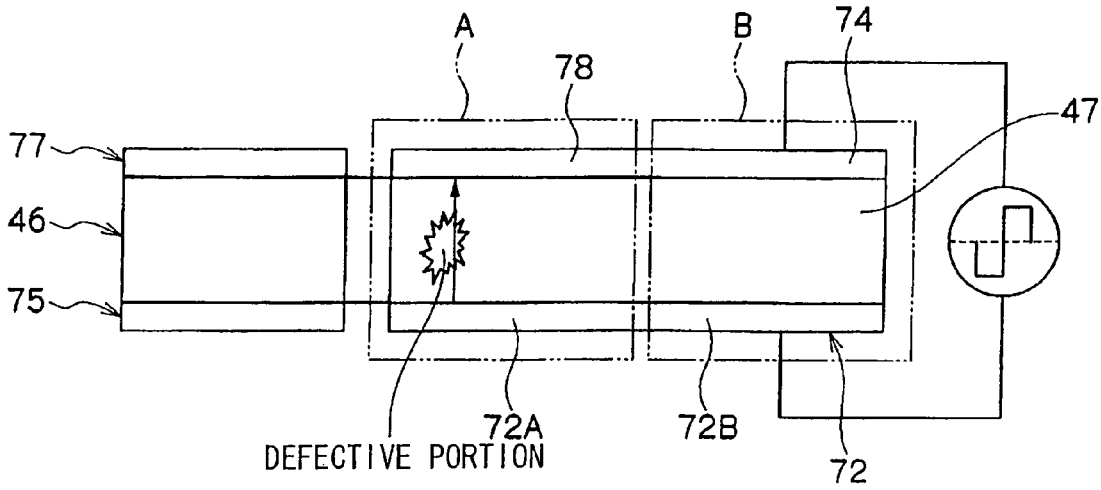
FIG. 17A is a schematic drawing showing a case in which there is a defective portion at the piezoelectric body, in a structure in which the individual electrodes and electrode members are not made to be the same potential.

Further, as shown in FIG. 17A, in a structure in which the individual electrodes 72 and the first electrode members 78 are not electrically connected and not made to be the same potential, if there is a defective portion such as a pin hole or the like at the piezoelectric body 46 at the two-dot chain line portion A which is not driven, there are cases in which large current flows instantaneously between the first electrode members 78 and the individual electrodes 72.

Figure 17B:
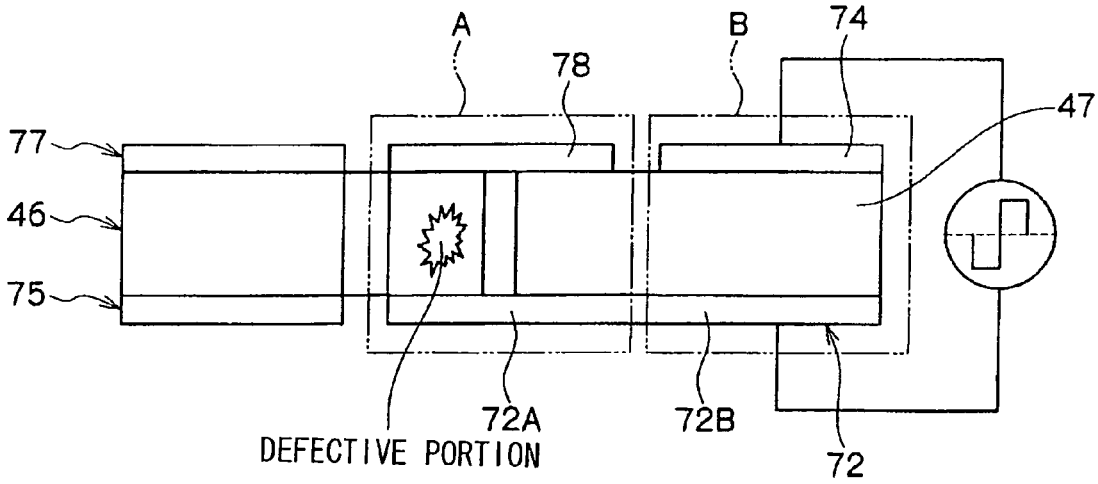
FIG. 17B is a schematic drawing showing a case in which there is a defective portion at the piezoelectric body, in a structure in which the individual electrodes and the electrode members are made to be the same potential.

In contrast, in a structure in which the individual electrodes 72 and the first electrodes members 78 are electrically connected and made to be the same potential as in the present modified example shown in FIG. 17B, even if there is a defective portion such as a pin hole or the like at the piezoelectric body 46 at the two-dot chain line portion A which is not driven, large current does not flow instantaneously between the first electrode members 78 and the individual electrodes 72.

Further in the present modified example, the common electrode 74 and the second electrode member 73 are electrically connected and are made to be the same potential. Therefore, even if there is a defective portion such as a pin hole or the like at the piezoelectric body 46, large current does not flow instantaneously between the common electrode 74 and the second electrode member 73.

Figure 18:
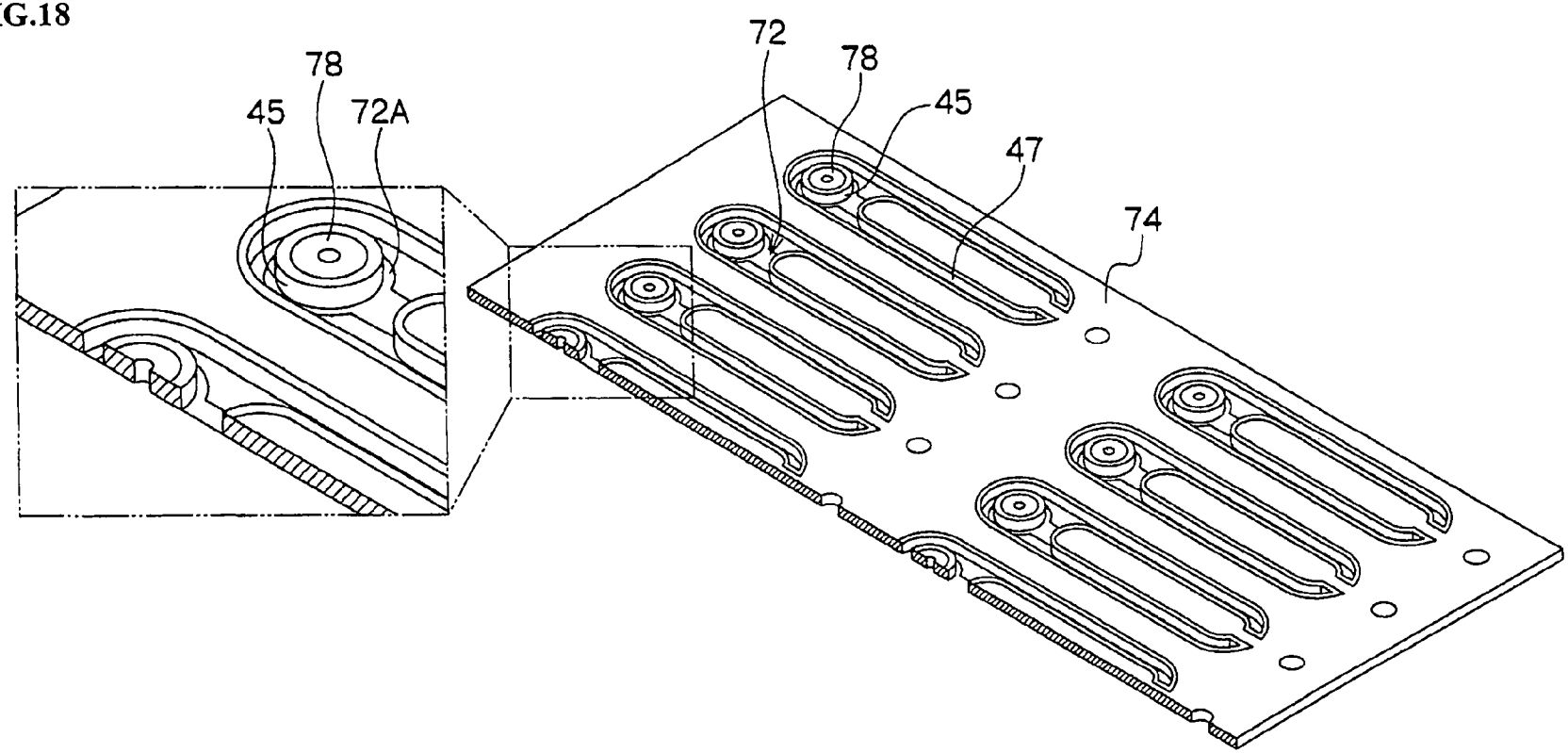
FIG. 18 is a drawing showing, in the modified example in which the arrangement of the individual electrodes and the common electrode is changed, a structure in which regions of the piezoelectric body where the electrode members are formed are separated from other regions.

Note that, as shown in FIG. 18, the separated piezoelectric bodies 47 may be structured such that regions 45 where the first electrode members 78 are formed are separated from other regions.

Figure 19:
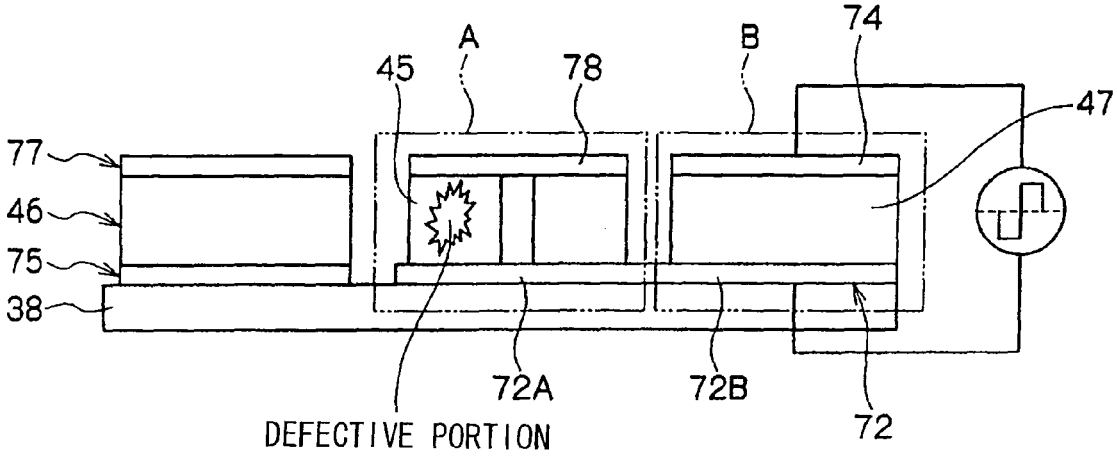
FIG. 19 is a schematic drawing showing a case in which there is a defective portion at the piezoelectric body, in the structure shown in FIG. 18.

In this structure, as shown in FIG. 19, in a structure in which the individual electrodes 72 and the first electrode members 78 are electrically connected and are made to be the same potential, even if there is a defective portion such as a pin hole or the like at the piezoelectric body 46 at the two-dot chain line portion A which is not driven, large current does not flow instantaneously between the first electrode members 78 and the individual electrodes 72. The present invention is not limited to the above-described exemplary embodiment, and various modifications, changes, and improvements are possible.

An object of the present invention is to provide a liquid droplet ejecting head and image forming device which reduce parasitic capacitance and aim for a reduction in the energy which is consumed.

A liquid droplet ejecting head of a first aspect of the present invention has: a plurality of pressure chambers in which a liquid is filled; nozzles communicating respectively with the plurality of pressure chambers, and ejecting the liquid as liquid droplets; a vibrating plate that forms portions of the plurality of pressure chambers; a piezoelectric body disposed above the vibrating plate and able to displace the vibrating plate; individual electrodes formed respectively for each of the plurality of pressure chambers at one of a bottom surface and a top surface of the piezoelectric body, the individual electrodes being one polarity of the piezoelectric body; a common electrode, formed at the other surface of the one of a bottom surface and a top surface of the piezoelectric body, so as to extend over the plurality of pressure chambers, the common electrode being the other polarity of the piezoelectric body; electrical connecting portions contacting predetermined regions of the individual electrodes, and electrically connected to the individual electrodes; and first electrode members formed on a same surface as the common electrode, and disposed at a side opposite a side at which the predetermined regions are located, with the piezoelectric body sandwiched therebetween, and electrically isolated from the common electrode.

A liquid droplet ejecting head of a second aspect of the present invention has the feature that, in the structure of the first aspect, the individual electrodes are formed on the bottom surface of the piezoelectric body, and the common electrode is formed on the top surface of the piezoelectric body, and the electrical connecting portions pass through from a top surface side of the piezoelectric body to a bottom surface side of the piezoelectric body and are electrically connected to the individual electrodes, and the first electrode members are electrically connected to the individual electrodes by the electrical connecting portions.

A liquid droplet ejecting head of a third aspect of the present invention, has the feature that the structure of the first aspect or the second aspect has a second electrode member which is formed on a same surface as the individual electrodes, and is electrically isolated from the individual electrodes, and is electrically connected to the common electrode.

A liquid droplet ejecting head of a fourth aspect of the present invention has the feature that, in the structure of any one of the first through third aspects, regions of the piezoelectric body where the first electrode members are formed are separated from other regions thereof.

An image forming device of a fifth aspect of the present invention has: the liquid droplet ejecting head of any one of the first through fourth aspects, which ejects liquid droplets onto a recording medium from the nozzles; a conveying portion conveying the recording medium; and a control portion supplying driving waveforms to the liquid droplet ejecting head on the basis of image data.

A liquid droplet ejecting head of a sixth aspect of the present invention has the feature that, the individual electrodes are provided with first end portions which are formed in circular shapes and contact the electrical connecting portions and are electrically connected thereto, and second end portions which are formed in elliptical shapes and are disposed above the pressure chambers, and connecting portions which connect the first end portions and the second end portions, wherein the first electrode members are disposed beneath the first end portions, with the piezoelectric body sandwiched therebetween.

A liquid droplet ejecting head of a seventh aspect of the present invention has the feature that, the individual electrodes and the second electrode member, and the common electrode and the first electrode members, are respectively separated from each other due to gaps being formed therebetween.

In accordance with the structure of the first aspect of the present invention, the piezoelectric body is not driven in vicinities of the electrical connecting portions. Therefore, as compared with a case which does not have the present structure, parasitic capacitance can be reduced, and a reduction in consumed energy can be devised.

In accordance with the structure of the second aspect of the present invention, the individual electrodes and the first electrode members are the same potential. Even if there is a defect at the piezoelectric body, shorts arising between the individual electrodes and the first electrode members can be prevented, as compared with a case which does not have the present structure.

In accordance with the structure of the third aspect of the present invention, the common electrode and the second electrode member are the same potential. Even if there is a defect at the piezoelectric body, shorts arising between the common electrode and the second electrode member can be prevented, as compared with a case which does not have the present structure.

In accordance with the structure of the fourth aspect of the present invention, even if there is a defect at the piezoelectric body, shorts arising between the individual electrodes and the common electrode can be prevented, as compared with a case which does not have the present structure.

In accordance with the structure of the fifth aspect of the present invention, the piezoelectric body is not driven in vicinities of the electrical connecting portions. Therefore, as compared with a case which does not have the present structure, parasitic capacitance can be reduced, and a reduction in consumed energy can be devised.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting head, comprising:

a plurality of pressure chambers in which a liquid is filled;

nozzles communicating respectively with the plurality of pressure chambers, and ejecting the liquid as liquid droplets;

a vibrating plate that forms portions of the plurality of pressure chambers;

a piezoelectric body disposed above the vibrating plate and able to displace the vibrating plate;

individual electrodes formed respectively for each of the plurality of pressure chambers at one of a bottom surface or a top surface of the piezoelectric body, the individual electrodes being one polarity of the piezoelectric body;

a common electrode, formed at the other surface of the one of a bottom surface or a top surface of the piezoelectric body, so as to extend over the plurality of pressure chambers, the common electrode being the other polarity of the piezoelectric body;

electrical connecting portions contacting predetermined regions of the individual electrodes, and electrically connected to the individual electrodes;

first electrode members formed on a same surface as the common electrode, and disposed at a side opposite a side at which the predetermined regions are located, with the piezoelectric body sandwiched therebetween, and electrically isolated from the common electrode; and a second electrode member which is formed on a same surface as the individual electrodes, and is electrically isolated from the individual electrodes, and is electrically connected to the common electrode.

2. The liquid droplet ejecting head of claim 1, wherein the individual electrodes are formed on the bottom surface of the piezoelectric body, and the common electrode is formed on the top surface of the piezoelectric body, and the electrical connecting portions pass through from a top surface side of the piezoelectric body to a bottom surface side of the piezoelectric body and are electrically connected to the individual electrodes, and the first electrode members are electrically connected to the individual electrodes by the electrical connecting portions.

3. The liquid droplet ejecting head of claim 1, wherein regions of the piezoelectric body where the first electrode members are formed are separated from other regions thereof.

4. The liquid droplet ejecting head of claim 1, wherein the individual electrodes are provided with first end portions which are formed in circular shapes and contact the electrical connecting portions and are electrically connected thereto, and second end portions which are formed in elliptical shapes and are disposed above the pressure chambers, and connecting portions which connect the first end portions and the second end portions, wherein the first electrode members are disposed beneath the first end portions, with the piezoelectric body sandwiched therebetween.

5. The liquid droplet ejecting head of claim 1, wherein the individual electrodes and the second electrode member, and the common electrode and the first electrode members, are respectively separated from each other due to gaps being formed therebetween.

6. An image forming device comprising:

a liquid droplet ejecting head that ejects liquid droplets onto a recording medium;

a conveying portion that conveys the recording medium; and a control portion that supplies driving waveforms to the liquid droplet ejecting head on the basis of image data, the liquid droplet ejecting head including:

a plurality of pressure chambers in which a liquid is filled;

nozzles communicating respectively with the plurality of pressure chambers, and ejecting the liquid as liquid droplets;

a vibrating plate that forms portions of the plurality of pressure chambers;

a piezoelectric body disposed above the vibrating plate and able to displace the vibrating plate;

individual electrodes formed respectively for each of the plurality of pressure chambers at one of a bottom surface or a top surface of the piezoelectric body, the individual electrodes being one polarity of the piezoelectric body;

a common electrode, formed at the other surface of the one of a bottom surface or a top surface of the piezoelectric body, so as to extend over the plurality of pressure chambers, the common electrode being the other polarity of the piezoelectric body;

electrical connecting portions contacting predetermined regions of the individual electrodes, and electrically connected to the individual electrodes;

first electrode members formed on a same surface as the common electrode, and disposed at a side opposite a side at which the predetermined regions are located, with the piezoelectric body sandwiched therebetween, and electrically isolated from the common electrode; and a second electrode member which is formed on a same surface as the individual electrodes, and is electrically isolated from the individual electrodes, and is electrically connected to the common electrode.

7. The image forming device of claim 6, wherein the individual electrodes are formed on the bottom surface of the piezoelectric body, and the common electrode is formed on the top surface of the piezoelectric body, and the electrical connecting portions pass through from a top surface side of the piezoelectric body to a bottom surface side of the piezoelectric body and are electrically connected to the individual electrodes, and the first electrode members are electrically connected to the individual electrodes by the electrical connecting portions.

8. The image forming device of claim 6, wherein regions of the piezoelectric body where the first electrode members are formed are separated from other regions thereof.

9. The image forming device of claim 6, wherein the individual electrodes are provided with first end portions which are formed in circular shapes and contact the electrical connecting portions and are electrically connected thereto, and second end portions which are formed in elliptical shapes and are disposed above the pressure chambers, and connecting portions which connect the first end portions and the second end portions, wherein the first electrode members are disposed beneath the first end portions, with the piezoelectric body sandwiched therebetween.

10. The image forming device of claim 6, wherein the individual electrodes and the second electrode member, and the common electrode and the first electrode members, are respectively separated from each other due to gaps being formed therebetween.

* * * * *